United States Patent [19]

Creager et al.

[11] 3,962,945

[45] June 15, 1976

[54] FOOT ACTUATED ELECTRONIC ORGAN

[75] Inventors: Wade E. Creager; Albert P. Sheppard, both of Atlanta, Ga.

[73] Assignee: Wade E. Creager, Atlanta, Ga.

[22] Filed: Dec. 11, 1974

[21] Appl. No.: 531,479

Related U.S. Application Data

[63] Continuation of Ser. No. 372,631, June 22, 1973, abandoned.

[52] U.S. Cl. ..... 84/1.01; 84/1.17; 84/426; 84/444; 84/DIG. 12; 84/DIG. 22; 84/DIG. 23; 84/DIG. 25

[51] Int. Cl.[2] ..... G10H 1/00; G10H 5/00

[58] Field of Search ..... 84/1.01, 1.03, 1.17, 84/1.24, 423–426, 443, 444, DIG. 2, DIG. 8, DIG. 12, DIG. 17, DIG. 22, DIG. 23, DIG. 25

[56] References Cited

UNITED STATES PATENTS

| | | | |
|---|---|---|---|
| 3,013,462 | 12/1961 | Combs | 84/DIG. 22 |
| 3,193,607 | 7/1965 | Anderson | 84/1.17 X |
| 3,305,620 | 2/1967 | Young | 84/1.17 |
| 3,433,881 | 3/1969 | Cotton | 84/1.17 |
| 3,567,838 | 3/1971 | Tennes et al. | 84/1.01 |
| 3,585,893 | 6/1971 | Arseneault | 84/1.17 |
| 3,624,263 | 11/1971 | Uchiyama | 84/1.03 |
| 3,665,088 | 5/1972 | Brand et al. | 84/1.01 |
| 3,708,602 | 1/1973 | Hiyama | 84/1.03 |
| 3,740,449 | 6/1973 | Southard | 84/1.01 |
| 3,752,898 | 8/1973 | Obayashi | 84/1.01 |

*Primary Examiner*—L. T. Hix
*Assistant Examiner*—Stanley J. Witkowski
*Attorney, Agent, or Firm*—Newton, Hopkins & Ormsby

[57] ABSTRACT

A musical instrument including an electronic organ provided with sound generators of an upper manual, a lower manual, a bass and a rhythm section. The sound generators are connected electrically to control switches in a console, these control switches being actuated by spaced horizontal, arcuately disposed, rows of main, switch actuating, pedals selectively operable by a person's left foot. The main pedals are disposed also in vertical rows corresponding to a basic note of a chord while the horizontal rows correspond to the key of each basic chord. A diode logic, in cooperation with the sound generators and control switches, dictates a prescribed chord of the lower manual sound generator to be sounded when a main pedal is depressed. An auxiliary switch which is actuated by a rhythm pedal operated by the right foot of a person, is adapted, when the additional chords are programmed by depression of a control pedal, to energize the sound generators of the upper manual for producing such additional compatible chords. The main pedals also actuate circuits to the sound generators of the bass and a switch, actuated by sidewise movement of the rhythm pedal, actuates the rhythm section.

12 Claims, 4 Drawing Figures

FOOT ACTUATED ELECTRONIC ORGAN

CROSS REFERENCE TO RELATED APPLICATIONS

This application is a continuation of application Ser. No. 372,631, entitled "Foot - Actuated Electronic Organ", filed June 22, 1973, now abandoned, and is also related to application Ser. No. 241,362 entitled "Musical Pedal Device with Plural Rows of Pedals", filed Apr. 5, 1972, commonly assigned and now abandoned which is incorporated herein by reference thereto.

BACKGROUND OF THE INVENTION

1. Field of the Invention

This invention relates to musical instruments and is more particularly concerned with a musical instrument having a plurality of rows of main pedals for generating prescribed musical chords, the pedals being actuated selectively by one foot and a rhythm foot pedal actuated by the other foot. The instrument provides accompaniment music, controlled essentially by a musician's feet, as the musician's hands are essentially free to manipulate other instruments.

2. Description of the Prior Art

The applicants are aware of the following United States prior art patents:

| | |
|---|---|
| 873,146 | 3,197,542 |
| 2,499,244 | 3,433,881 |
| 2,625,070 | 3,585,893 |
| 2,900,862 | |

The versatility and broad musical sound simulation ability of the modern electronic organ are almost unprecedented for live musical performances. However, this instrument grossly limits what the performer can do, otherwise, in that to play such an instrument, usually both hands and both feet are needed. Modern performances normally lean toward a lead instrument, such as the guitar, horn or reed instrument, with the electronic organ serving as background accompaniment. The present invention obviates these problems and permits a musician to play an organ with his feet while playing another instrument with his hands.

SUMMARY OF THE INVENTION

This invention provides a new musical instrument which has the sound flexibility of the electronic organ but which can be played with only the feet (using a hand-to-adjust "stops", occasionally) leaving the hands free to play one of the lead instruments. Obviously, it is not desirable to reproduce the organ keyboard for any foot arrangement, yet there is a potential for using the many sound combinations of the organ to be actuated by a series of foot pedals. The implementation of this concept is briefly described below:

The electronic organ consists typically of an upper manual keyboard, a lower manual keyboard, an octave of bass chords selected by foot pedals and a foot-actuated sound intensity control. In addition, there are "stops" which select various instrument sounds such as piano, harpsichord, oboe, flute, etc. as well as esoteric accompaniment such as "walking bass", "eight section rhythm", etc. characteristic of the promotional efforts of the various electronic organ manufacturers, although still powerful for full and pleasing sounds.

The invention described herein utilizes the optimum musical combinations of these instruments by fitting the already developed organ circuitry into a new and unique pedal arrangement which selects many chord and note combinations available in the organ circuits by the use of computer diode matrix logic or other equivalent forms of logic.

In the embodiment of the present invention depicted herein, there are sixty-five main foot pedals, although any number might be selected. These main pedals actuate switches which are connected to the computer diode matrix logic circuitry which, in turn, actuates various full chord combinations. The main pedals are arranged in horizontal and vertical rows so that there are thirteen vertical rows of pedals with five pedals per vertical row equally spaced from each other.

The first or lowest horizontal row of thirteen pedals selects thirteen major chord combinations that would be available by playing from the upper manual, lower manual and foot pedals of the electronic organ circuitry with total availability of the various stops and other controls.

The second lowest row of pedals respectively actuate thirteen minor chord-note combinations; the third row, the thirteen seventh chord-note combinations; the fourth row, the diminished chord-note combinations; and the fifth row, the augmented chord-note combinations. Obviously, any note-chord combinations could be prescribed, if desired.

Another feature of the invention is a "rhythm pedal" or auxiliary pedal which is actuated by the right foot. The "rhythm pedal" is spring biased and pivots both about a horizontal axis and a vertical axis. When pivoted about the horizontal axis it controls the connection of the upper manual circuitry of the organ to the sixty-five foot pedals and the logic associated, therewith.

Twelve notes are brought from the upper manual circuitry and thirteen chords are brought from the lower manual circuitry. With the rhythm pedal and a main pedal, simultaneously depressed, the logic selects any one of sixty-five, four or more note combinations from twelve sound generators of both the lower manual circuitry and the upper manual circuitry. With a main pedal alone, depressed, the logic selects one of sixty-five, four chord combinations directly from thirteen sound generators of the lower manual circuitry. The same main pedal also selects the appropriate chord of the organ pedal circuits. While this is being done the "eight section rhythm", the "walking bass", etc. of the rhythm section are energized or de-energized, depending on the lateral position of the rhythm pedal and are performing normally, when so energized.

The resulting sound, using the "rhythm pedal" and sixty-five main foot pedals is a melodious accompaniment consisting of nine chord-notes with appropriately rhythm paced four note combination melody. The performer is thus free to play his hand operated instrument, as the lead.

DETAILED DESCRIPTION

Figure 1:
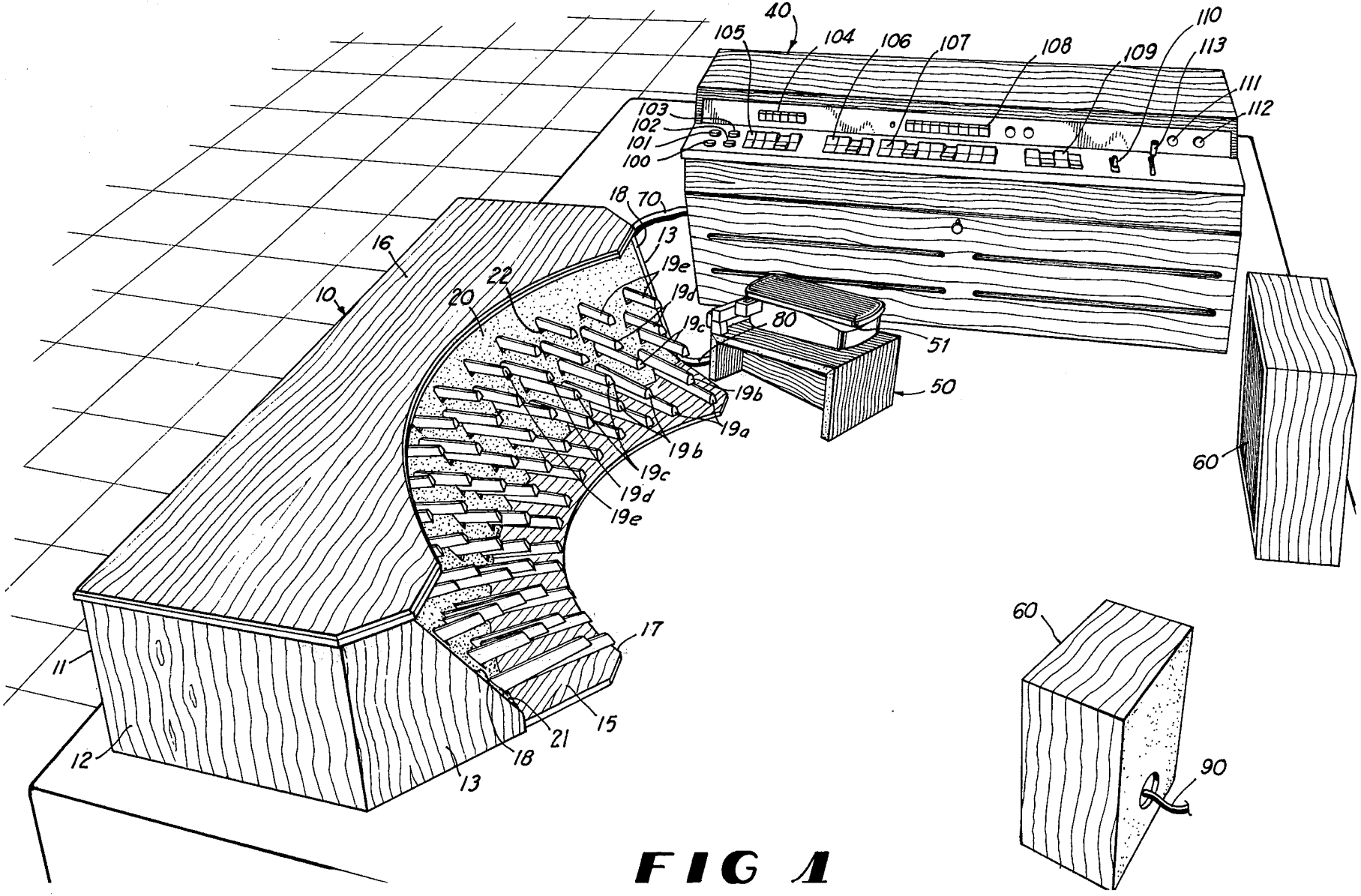
FIG. 1 is a perspective view of a musical instrument constructed in accordance with the present invention.

In general, the instrument of the present invention includes a main foot pedal console 10, an electronic organ 40, a rhythm or auxiliary pedal assembly 50 and a plurality of speakers 60 connected by cables 70, 80 and 90. In the arrangement of FIG. 1, the main foot pedals 19*a*, 19*b*, 19*c*, 19*d* and 19*e* form the keyboard of console 10 and are selectively operated by the left foot of a musician. The single auxiliary or rhythm pedal 51 is operated by the right foot of the musician.

The electronic organ consists of a bass 41, a rhythm section 42, a lower manual 43 and an upper manual 44. The electronic organ 40 in the present embodiment is a "Gulbransen Pacemaker" electronic organ to which is connected the "Leslie" speakers 60 via cable 90.

The function of the main foot pedals 19*a*, 19*b*, 19*c*, 19*d* and 19*e* is to energize prescribed organ pedal circuits of the base 41, to energize chord circuits of the lower manual 43 and to program compatible chord circuits of upper manual 44 for energization.

The functions of the auxiliary or rhythm pedal 51 is:

a. when it is rocked up and down to throw out and in, the programmed chord circuits of the upper manual 44, and b. when rocked sidewise, to throw in the programmed rhythm section 42.

The pedals 19*a* of the lowest row are for the major chords, the pedals 19*b* are for the minor chords, the pedals 19*c* are for the 7th chords, the pedals 19*d* are for the diminished chords and the pedals 19*e* are for the augmented chords.

At the center of the keyboard the pedals 19*a*, 19*b*, 19*c*, 19*d* and 19*e* are for the C chord. To the right there are the "sharps" and to the left the "flats". Therefore, the vertical row of pedals next adjacent the center row, to the left is for the key of D (one sharp) and to the right is for the key of F (one flat), etc. Thus, from left to right, the vertical rows of pedals 19*a*, 19*b*, 19*c*, 19*d* and 19*e* are for the keys of G flat (6 flats), D flat (5 flats), A flat (4 flats), E flat (3 flats), B flat (2 flats), F (one flat), D, C, G (one sharp), D (two sharps), A (3 sharps), E (four sharps), E (5 sharps), and F sharp (6 sharps).

In more detail the console or housing 10 includes a straight rectangular back 11, a pair of opposed rectangular sides, such as side 12, extending forwardly from the edges of said back 11 and a pair of complimentary, forwardly tapered wing panels 13. The console 10 also has a flat top 14 and a base or bottom 15.

The forward arcuate edges 16 and 17 of the top 14 and bottom 15 are concentric and concaved, the forward edge portion of top 14 overhanging wing panel 13 and the forward edge portion of base 15 protruding forwardly of the wing panel 13 and edge 16.

Disposed between the upwardly and rearwardly inclined forward edges 18 of wing panel 13 and disposed also between top 14 and bottom 15 is the arcuate concaved front panel 20. The bottom edge 21 of the front panel 20 rests upon the upper surfaces of bottom 17 and is concentric with edges 16 and 17, the arcuate concaved surface of panel 20, however, has an axis inclined so as to be parallel with edges 18.

The panel 20 is provided with sixty-five apertures or holes 22 through which the forward end portions of the main foot pedals 19*a*, 19*b*, 19*c*, 19*d* and 19*e*, project. The holes 22 are arranged in five equally vertically and horizontally spaced horizontal rows or tiers, thirteen to a row. The holes 22 in each row are equally spaced from each other; however, alternate holes 22, in each vertical row of holes 22 are offset from the adjacent upper and/or lower hole 22 in that vertical row. Hence, the main foot pedals 19*a*, 19*b*, 19*c*, 19*d* and 19*e* which project through a vertical row of holes 22, are staggered vertically so that alternate foot pedals 19*a*, 19*c*, and 19*e* are vertically aligned, as are pedals 19*b* and 19*d*. Also, the main foot pedals 19*a*, 19*b*, 19*c*, 19*d* and 19*e* of each horizontal row are in a common plane parallel to the common plane of the other horizontal rows. The main foot pedals, 19*a*, 19*b*, 19*c*, 19*d* and 19*e* are also radially disposed with respect to a common vertical axis, the axis coinciding with the axis of the concentric edges 16, 17 and 21.

Figure 3:
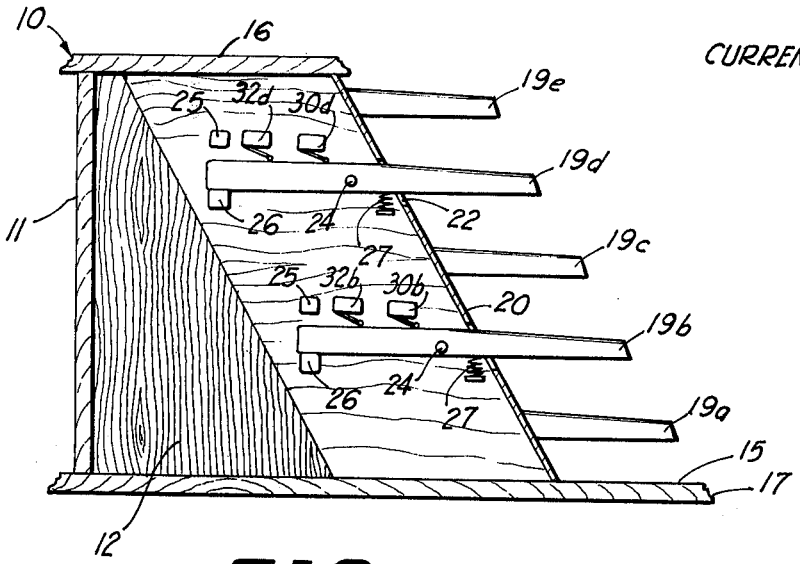
FIG. 3 is a vertical sectional view of the console showing the pivot mounting of one row of main pedals of the instrument of FIG. 1.

As illustrated in FIG. 3, each of the sixty-five pedals 19*a*, 19*b*, 19*c*, 19*d* and 19*e* are respectively, pivotally mounted by their mid portion on horizontally disposed pivot pins 24 carried by vertical struts 29 in the console 10, slightly inwardly of the front 20. In the central portion of the console 10, each pedal 19*a*, 19*b*, 19*c*, 19*d* and 19*e* is provided with a pair of opposed stops 25 and 26 carried by strut 29 which are disposed on opposite sides of the inner end portion of each pedal 19*a*, 19*b*, 19*c*, 19*d* or 19*e* and limit its movement. A spring 27, between the strut 29 and each pedal 19*a*, 19*b*, 19*c*, 19*d* or 19*e* normally urges the pedal 19*a*, 19*b*, 19*c*, 19*d* or 19*e* against its lower stop 26. Pressure downwardly on the outer end portion of a pedal 19*a*, 19*b*, 19*c*, 19*d* or 19*e* will pivot it against its upper stops 25 to close a pair of normally open switches, i.e. a bass circuit switch 30*a*, 30*b*, 30*c*, 30*d* or 30*e* and a control switch 32*a*, 32*b*, 32*c*, 32*d* or 32*e*. For example, the depressing of pedal 19*a* of FIGS. 3 and 4 will close the bass circuit switch 30*a* and the control switch 32*a*. In like manner in FIGS. 3 and 4, the depressing of pedal 19*b* will close switches 30*b* and 32*b*; the depressing of pedal 19*c* will close switches 30*c* and 32*c*; the depressing of pedal 19*d* will close switches 30*d* and 32*d* and the depressing of pedal 19*e* will close switches 30*e* and 32*e*.

Figure 4:
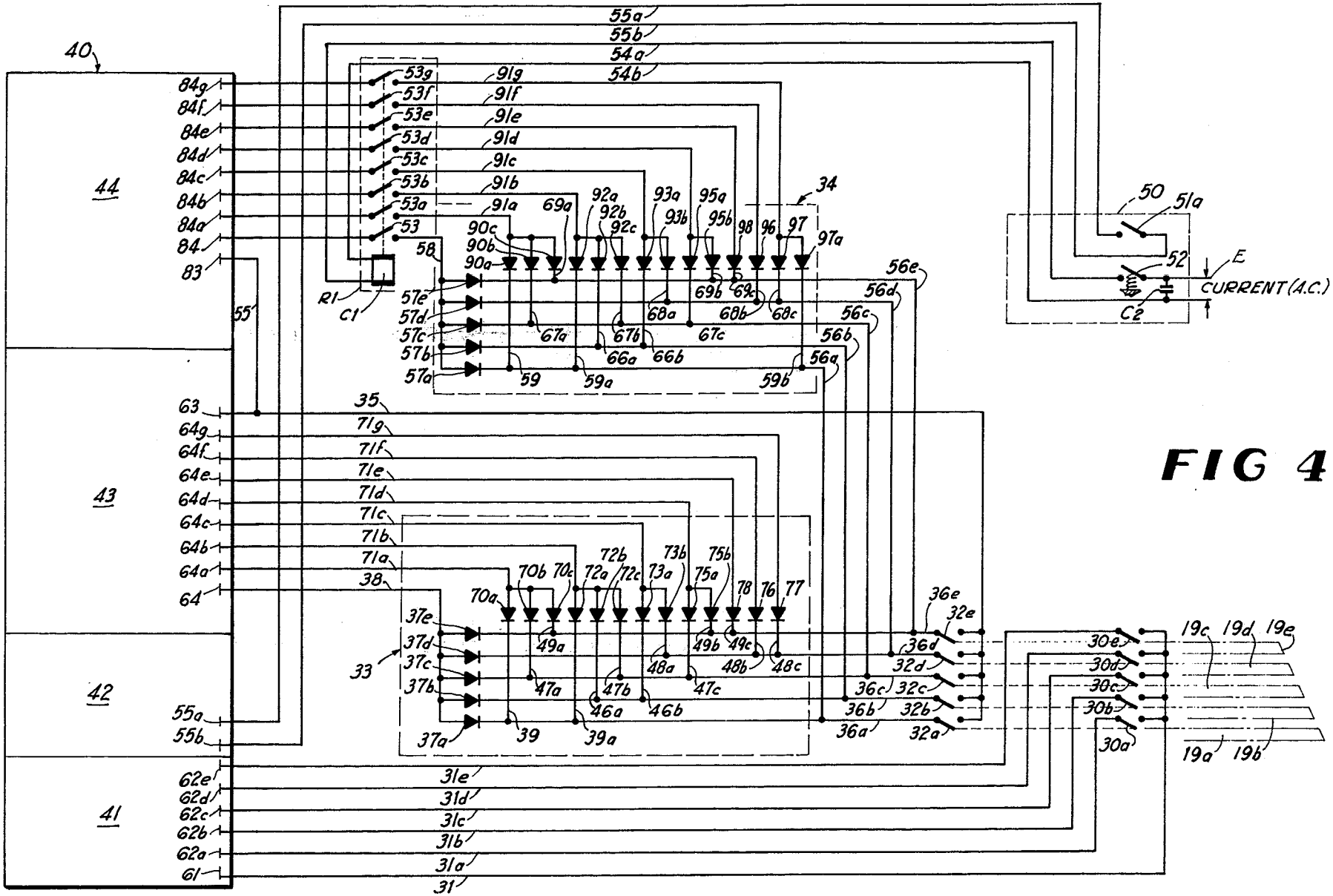
FIG. 4 is a schematic wiring diagram showing the wiring for one vertical row of main pedals of the instrument shown in FIG. 1.

In FIG. 4 a typical wiring diagram for one vertical row of pedals is provided. Such a vertical row includes the pedals 19*a*, 19*b*, 19*c*, 19*d* and 19*e*, for example, in the key of C row. The electrical circuitry for this selected "C" vertical row of FIG. 4 includes a neutral bus 31 connected by one end to the neutral bus 61 of the circuitry of bass 41. The other end of bus 31 is connected to the terminals of each of the switches 30*a*, 30*b*, 30*c*, 30*d* and 30*e*. Thus, neutral bus 31 is common to all switches 30*a*, 30*b*, 30*c*, 30*d* and 30*e*.

The other terminals of switches 30*a*, 30*b*, 30*c*, 30*d* and 30*e*, however, are respectively connected by basses 31*a*, 31*b*, 31*c*, 31*d*, and 31*e* to the wires 62*a*, 62*b*, 62*c*, 62*d* and 62*e*, leading to the hot side of the respective pedal switches (not shown) of the bass 41. Thus, switches 30*a*, 30*b*, 30*c*, 30*d* and 30*e* are disposed in parallel, respectively with and function to shunt the bass switches (not shown) which are conventionally controlled by the depression of the pedals of organ 40. Therefore, bass switches 30*a*, 30*b*, 30*c*, 30*d* and 30*e* selectively complete and break circuits to the oscillators or sound generators of the bass notes for generating appropriate base sounds in response to the depressing of a pedal 19*a*, 19*b*, 19*c*, 19*d* or 19*e*.

The control switches 32*a*, 32*b*, 32*c*, 32*d* and 32*e* are respectively coupled with switches 30*a*, 30*b*, 30*c*, 30*d* and 30*e*. These switches 32*a*, 32*b*, 32*c*, 32 and 32*e* control the lower manual 43 through a lower manual diode matrix or logic, denoted generally by numeral 33. These control switches 32*a*, 32*b*, 32*c*, 32*d* and 32*e*, as mentioned above, also program the upper manual 44, through the upper numeral diode matrix or logic, denoted generally by manual 34; however, energization and de-energization of the upper manual is controlled by a gate member, such as the relay 36, which, in turn, is controlled through switch 52 of the rhythm pedal assembly 50.

In more detail, the neutral bus 63 of the lower manual circuitry, i.e. lower manual 43, is connected to the terminals on one side of all switches 32*a*, 32*b*, 32*c*, 32*d* and 32*e* so as to be common to these switches. The other sides of switches 32*a*, 32*b*, 32*c*, 32*d* and 32*e* are, respectively connected via wires 36*a*, 36*b*, 36*c*, 36*d* and 36*e*, respectively through diodes 37*a*, 37*b*, 37*c*, 37*d* and 37*e*, to a wire 38, common to all the aforesaid diodes. Wire 38 is connected to the hot "C" wire 64 leading to the C key switch of the lower manual 43. Therefore, the closing of any one of switches 32*a*, 32*b*, 32*c*, 32*d* and 32*e* will cause the organ 40 to generate in its sound generators a note of C, as if the C key of the lower manual 43 had been depressed.

Connected to the C major switch 32*a*, i.e. wire 36*a*, are wires 39 and 39*a*. Wire 39 leads via diode 70*a* and wire 71*a* to the hot wire 64*a* for note G of the lower manual 43. Wire 39*a* leads, via diode 72*a* and wire 71*b* to the hot wire 64*b* for note E of the lower manual 43. Therefore, the closing of the C major switch 32*a* creates a chord including the notes C, E and G.

The following Table I gives the notes produced by respective depression of the pedals 19*a*, 19*b*, 19*c*, 19*d* and 19*e* through the closing switches 32*a*, 32*b*, 32*c*, 32*d* and 32*e*. The additional wiring therefore includes wires 46*a* and 36*b* connected to wire 36*b*. The wire 46*a* leads, via diode 72*b*, to wire 71*b* for producing a G note. The wire 46*b* leads, via diode 73*a* and wire 71*c*, to wire 64*c* in the upper manual circuitry for shunting the E flat key of the lower manual. Thus, depression of the C minor pedal 19*b* of the C chord produces C, F flat and G on the lower manual.

In like fashion, wires 47*a*, 47*b* and 47*c* are connected to wire 36*c*. The wire 47a leads, via diode 70*b* to wire 71*a* for producing an E note. The wire 47*b* leads via diode 72*c* to wire 71 for producing a G note and wire 47*c* leads, via diode 75*a* and wire 71*d* to wire 64*d* for shunting the B flat key of the lower manual. Thus, the depression of C seventh pedal 19c produces the notes C, E, G and B flat.

Connected to wire 36*d* for providing circuitry for switch 32*d* are wires 48*a*, 48*b* and 48*c*. Wire 48a leads, through diode 73*b*, to wire 71*c* for producing an E flat. Wire 48*b* leads, through diode 76 and wire 71*f* to the hot wire 64*f* of the lower manual circuitry for shunting the G flat key switch (not shown) of lower manual 43. Wire 48*c* leads via diode 77 and wire 71*g* to the hot wire 64*g* of the lower manual circuitry for shunting the A key switch (not shown) of the lower manual 43. Thus the depression of the C diminished pedal 19*d* will produce a chord consisting of the notes C, E flat, G flat and A.

The augmented C circuit includes wires 49*a*, 49*b*, and 49*c* all connected to wire 36*e*. The wire 49*a* is connected, through diode 70*c* to wire 71*a*. The wire 49*b* is connected through diode 75*b* to wire 71*d*. The wire 49*c* is connected by diode 78 to wire 71*e* which, in turn, is connected to the hot wire 64*e* of the lower manual circuitry. This hot wire 64*e* leads to the switch (not shown) of the G sharp key of the lower manual 43. Thus, the depressing of the C augmented pedal 19*e* will produce a chord including the notes C, E, B flat and G sharp.

The diode matrix logic 34 is a duplication of the diode matrix logic 33 to provide the same chords in the upper manual 44 as in the lower manual 43, except that an A note is added to the C major chord. The chords for each pedal are shown in Table II.

The wiring diagram of FIG. 4 includes wires 56*a*, 56*b*, 56*c*, 56*d* and 56*e* connected from wires 36*a*, 36*b*, 36*c*, 36*d* and 36*e* to the diode matrix logic 34. Each of wires 56*a*, 56*b*, 56*c*, 56*d* and 56*e* are connected to a common wire 58 through respective diodes 57*a*, 57*b*, 57*c*, 57and 57*e*. The wire 58 which is common to all wires 56*a*, 56*b*, 56*c*, 56*d* and 56*e* is connected to one terminal of a normally open switch 53 of the relay R1, the other terminal which is connected to hot wire 84 of the upper manual. The neutral bus 83 of the upper manual 44 is connected, by wire 55, to the neutral bus wire 35. Thus, the C note which will be generated by the closing of any one of the switches 32*a*, 32*b*, 32*c*, 32*d* or 32*e* will be generated through energization of wire 84, provided switch 55 is closed.

The wire 56*a* is connected by wire 59 and diode 90*a* to wire 91*a* and thence to a terminal of switch 54*a*. The other terminal of switch 53*a* is connected to hot wire 84*a* which is the hot wire for the E note of the upper manual. In like fashion, wire 59*a* which is connected to wire 56*a* leads through a diode 92*a* and by wire 91*b* to the terminal of switch 53*b*. The other terminal switch 53*b* is connected to the hot wire 84*b* of the upper manual 44 for creating a G note. Furthemore, wire 59*b* which is connected to wire 56*a* leads via diode 97*a* to wire 91*g* and to the teminal of switch 53*g*. The other teminal of switch 53*g* is connected to hot wire 84*g* of the upper manual circuitry of upper manual 44 for producing an A note. Therefore, the closing of switches 32*a* and 53 will cause the upper manual to generate a chord including the notes C, E, G and A.

In like fashion, the wire 56*b* is connected by wire 66*a* through diode 92*b* to the wire 91*b*. Also wire 56*b* is connected via wire 66*b* and diode 93*a* via wire 91*c* to switch 53*c*. The other terminal of switch 53*c* is connected to hot wire 84*c* of the upper manual 44 for producing an E flat. Therefore, upon the closing of switch 32*b*, and the switches 53*b* and 53*c*, the chord consisting of the notes C, G and E flat are produced by the upper manual circuitry of organ 40. The wire 56*c* is connected to wires 67*a*, 67*b*, and 67*c*, the wire 67*a* being connected through diode 90*b* to wire 91*a;* the wire 67*b* being connected through diode 92*c* to wire 91*b* and the wire 67*c* being connected through diode 95*a* to wire 91*d*. The wire 91*d*, in turn, is connected to the terminal of switch 53*d*, the other terminal of which is connected to hot wire 84*d* for producing a B flat note from the circuitry of the upper manual 44. Therefore, when switch 32*c* is closed and the switches 53, 53*a*, 53*b* and 53*d* are closed, a chord is sounded by the upper manual which includes the notes C, E, G and B flat.

The wire 56*d* is connected to wires 68*a*, 68*b* and 68*c*. The wire 68*a* leads through diode 97 to wire 91g which in turn is connected to one terminal of switch 53*g*, the other terminal of which is connected to the hot wire 84*g* for producing an A note in the upper manual circuitry of manual 44. The wire 68*b* is connected through diode 96 to wire 91f, which in turn is connected to one terminal of switch 53*f*, the other terminal of which is connected to hot wire 84*f* for producing a G flat from the circuitry of the upper manual 44. The wire 68*c* is connected through diode 93*b* to the wire 91*c*. Therefore, the depressing of foot pedal 19*d* for producing a C diminished, causes the upper manual to generate a chord which includes the notes C, E, G flat and A.

The wire 56*e* is connected to wires 69*a*, 69*b* and 69*c*. The wire 69*a* is connected by diode 90*c* to wire 91a. The wire 69*b* is connected by diode 95*b* to wire 91*d* and the wire 69*c* is connected by diode 98 to wire 91*c*. Therefore, the closing of switch 62*e* and the closing of switches 53, 53*a*, 53*d* and 53*e* will cause the upper manual to generate a chord consisting of C, E, G sharp and B flat. These chords, generated by the upper manual in response to the C pedals are contained in Table II. As seen in FIG. 4, the switch 51*a* of the rhythm pedal assembly is connected by wires 55*a* and 55*b* to the circuitry of the rhythm section 42 so as to cut down this rhythm section 42 on and off as the switch 51*a* is closed and open.

The spring loaded switch 52 is connected by wires 54*a* and 54*b* to the coil C1 of relay R1. The closing of switch 52, therefore, energizes coil C1 from a current source E so as to close simultaneously the switches 53, 53*a*, 53*b*, 53*c*, 53*d*, 53*e*, 53*f* and 53*g*. When the switch 52 is opened, the coil C1 is de-energized to permit switches 53, 53*a*, 53*b*, 53*c*, 53*d*, 53*e*, 53*f* and 53*g* to open. The capacitor C1 is to prevent excessive sparking of switch 52. As pointed out above the switch 51a is closed upon sidewise movement of the foot pedal or foot pedal assembly 51, white the switch 52 is closed upon depression of the foot pedal 51.

Figure 2:
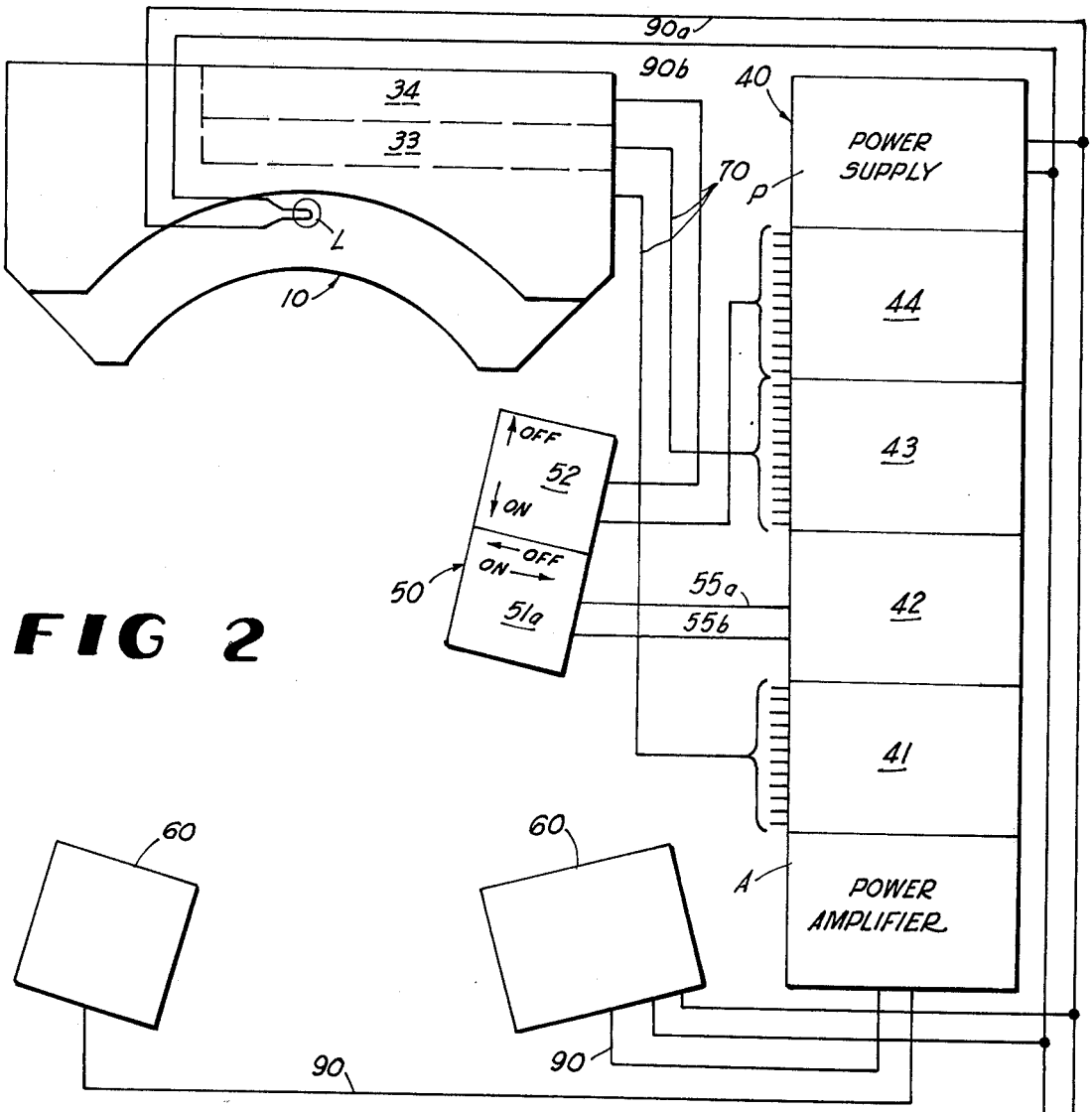
FIG. 2 is a schematic plan view of the instrument shown in FIG. 1.

In FIG. 2, wires 90*a*, 90*b* supply current from current source E to light lamp L and to the conventional power supply P of organ 40. The organ 40 also has as is conventional a power amplifier A for amplifying the current to speaker 60.

A better understanding of the present invention will be had by reference to the accompanying tables wherein the chords generated upon depression of each of the foot pedals is listed.

TABLE I

Logic for Lower Manual
(Key of C)
Center Row of Pedals

| Pedal | Pedal Number | Notes Produced |
|---|---|---|
| C Augmented | 19e | C; E; G sharp; B flat |
| C Diminished | 19d | C; E flat; G flat; A |
| C Seventh | 19c | C; E; G; B flat |
| C Minor | 19b | C; E flat; G |
| C Major | 19a | C; E; G |

TABLE II

Logic for Upper Manual
(Key of C)
Center Row of Pedals

| Pedal | Pedal Number | Notes Programmed |
|---|---|---|
| C Augmented | 19e | C; H; G sharp; B flat |
| C Diminished | 19d | C; E flat; G flat; A |
| C Seventh | 19c | C; E; G; B flat |
| C Minor | 19b | C; G; E flat |

TABLE II-continued

Logic for Upper Manual
(Key of C)
Center Row of Pedals

| Pedal | Pedal Number | Notes Programmed |
|---|---|---|
| C Major | 19a | C; E; G; A |

TABLE III

Logic for Lower Manual
(One Flat)
First Row of Pedals to Left of Center

| Pedal | Pedal Number | Notes Produced |
|---|---|---|
| F Augmented | 19e | F; A; C sharp; E flat |
| F Diminished | 19d | F; A flat; B; D |
| F Seventh | 19c | F; A; C; E flat |
| F Minor | 19b | F; A flat; C |
| F Major | 19a | F; A; C |

TABLE IV

Upper Manual
(One Flat)
First Row of Pedals to Left of Center

| Pedals in Sixth Row | Pedal Number | Notes Programmed |
|---|---|---|
| F Augmented | 19e | F; A; C sharp; E flat |
| F Diminished | 19d | F; A flat; B |
| F Seventh | 19c | F; A; C; E flat |
| F Minor | 19b | F; A flat; C |
| F Major | 19a | F; A; C; D |

TABLE V

Lower Manual
(Two Flats)
Second Row of Pedals to Left of Center

| Pedal | Pedal Number | Notes Produced |
|---|---|---|
| B Flat Augmented | 19e | B flat; D; F sharp; A flat |
| B Flat Diminished | 19d | B flat; D flat; F flat; G |
| B Flat Seventh | 19c | B flat; D; F; A flat |
| B Flat Minor | 19b | B flat; D flat; F |
| B Flat Major | 19a | B flat; D; F |

TABLE VI

Upper Manual
(Two Flats)
Second Row of Pedals to Left of Center

| Pedal | Pedal Number | Notes Programmed |
|---|---|---|
| B Flat Augmented | 19e | B flat; D; F sharp; A flat |
| B Flat Diminished | 19d | B flat; D flat; F flat; G |
| B Flat Seventh | 19c | B flat; D; F; A flat |
| B Flat Minor | 19b | B flat; D flat; F |
| B Flat Major | 19a | B flat; D; F; G |

TABLE VII

Lower Manual
(Three Flats)
Third Row of Pedals to Left of Center

| Pedal | Pedal Number | Notes Produced |
|---|---|---|
| E Flat Augmented | 19e | E flat; G; B; D |
| E Flat Diminished | 19d | E flat; G flat; A; C |
| E Flat Seventh | 19c | E flat; B flat; D flat |
| E Flat Minor | 19b | E flat; G flat; B flat |

TABLE VII-continued

Lower Manual
(Three Flats)
Third Row of Pedals to Left of Center

| Pedal | Pedal Number | Notes Produced |
|---|---|---|
| E Flat Major | 19a | E flat; G; B flat |

TABLE IX

Logic for Lower Manual
(Four Flats)
Fourth Row of Pedals to Left of Center

| Pedal | Pedal Number | Notes Produced |
|---|---|---|
| A Flat Augmented | 19e | A flat; C; E; G flat |
| A Flat Diminished | 19d | A flat; C flat; D; F |
| A Flat Seventh | 19c | A flat; C; E flat; G flat |
| A Flat Minor | 19b | A flat; C flat; E flat |
| A Flat Major | 19a | A flat; C; E flat |

TABLE X

Logic for Upper Manual
(Four Flats)
Fourth Row of Pedals to Left of Center

| Pedal | Pedal Number | Notes Programmed |
|---|---|---|
| A Flat Augmented | 19e | A flat; C; E; G flat |
| A Flat Diminished | 19d | A flat; C flat; D; F |
| A Flat Seventh | 19c | A flat; C; E flat; G flat |
| A Flat Minor | 19b | A flat; C flat; E flat |
| A Flat Major | 19a | A flat; C; E flat; F |

TABLE XI

Logic for Lower Manual
(Five Flats)
Fifth Row of Pedals to Left of Center

| Pedal | Pedal Number | Notes Produced |
|---|---|---|
| D Flat Augmented | 19e | D flat; F; A; C flat |
| D Flat Diminished | 19d | D flat; F flat; G; B flat |
| D Flat Seventh | 19c | D flat; F; A flat; C flat |
| D Flat Minor | 19b | D flat; F flat; A flat |
| D Flat Major | 19a | D flat; F; A flat |

TABLE XII

Logic for Upper Manual
(Five Flats)
Fifth Row of Pedals to Left of Center

| Pedal | Pedal Number | Notes Programmed |
|---|---|---|
| D Flat Augmented | 19e | D flat; F; A; C flat |
| D Flat Diminished | 19d | D flat; F flat; B flat |
| D Flat Seventh | 19c | D flat; F; A flat; C flat |
| D Flat Minor | 19b | D flat; F flat; A flat |
| D Flat Major | 19a | D flat; F; A flat; B flat |

TABLE XIII

Logic for Lower Manual
(Six Flats)
Sixth Row of Pedals to Left of Center

| Pedal | Pedal Number | Notes Produced |
|---|---|---|
| G Flat Augmented | 19e | G flat; B flat; G; E |
| G Flat Diminished | 19d | G flat; A; C; E flat |
| G Flat Seventh | 19c | G flat; B flat; D flat; E |

TABLE XIII-continued

Logic for Lower Manual
(Six Flats)
Sixth Row of Pedals to Left of Center

| Pedal | Pedal Number | Notes Produced |
|---|---|---|
| G Flat Minor | 19b | G flat; A; D flat |
| G Flat Major | 19a | G flat; B flat; D flat |

TABLE XIV

Logic for Upper Manual
(Six Flats)
Sixth Row of Pedals to Left of Center

| Pedal | Pedal Number | Notes Programmed |
|---|---|---|
| G Flat Augmented | 19e | G flat; B flat; G; E |
| G Flat Diminished | 19d | G flat; A; C; E flat |
| G Flat Seventh | 19c | G flat; B flat; D flat; E |
| G Flat Minor | 19b | G flat; A; D flat |
| G Flat Major | 19a | G flat; B flat; D flat; E flat |

TABLE XV

Logic for Lower Manual
(One Sharp)
First Row of Pedals to Right of Center

| Pedal | Pedal Number | Notes Produced |
|---|---|---|
| G Augmented | 19e | G; B; D sharp; F |
| G Diminished | 19d | G; B flat; D flat; E |
| G Seventh | 19c | G; B; D; F |
| G Minor | 19b | G; B flat; D |
| G Major | 19a | G; B; D |

TABLE XVI

Logic for Upper Manual
(One Sharp)
First Row of Pedals to Right of Center

| Pedal | Pedal Number | Notes Programmed |
|---|---|---|
| G Augmented | 19e | G; B; D sharp; F |
| G Diminished | 19d | G; B flat; D flat; E |
| G Seventh | 19c | G; B; D; F |
| G Minor | 19b | G; B flat; D |
| G Major | 19a | G; B; D; E |

TABLE XVII

Logic for Lower Manual
(Two Sharps)
Second Row of Pedals to Right of Center

| Pedal | Pedal Number | Notes Produced |
|---|---|---|
| D Augmented | 19e | D; F sharp; A sharp; C |
| D Diminished | 19d | D; F; A flat; B |
| D Seventh | 19c | D; F sharp; A; C |
| D Minor | 19b | D; F; A |
| D Major | 19a | D; F sharp; A |

TABLE XVIII

Logic for Upper Manual
(Two Sharps)
Second Row of Pedals to Right of Center

| Pedal | Pedal Number | Notes Programmed |
|---|---|---|
| D Augmented | 19e | D; F sharp; A sharp; C |
| D Diminished | 19d | D; F; A flat; B |
| D Seventh | 19c | D; F sharp; A; C |
| D Minor | 19b | D; F; A |

TABLE XVIII-continued

Logic for Upper Manual
(Two Sharps)
Second Row of Pedals to Right of Center

| Pedal | Pedal Number | Notes Programmed |
|---|---|---|
| D Major | 19a | D; F sharp; A; B |

TABLE XIX

Logic for Lower Manual
(Three Sharps)
Third Row of Pedals to Right of Center

| Pedal | Pedal Number | Notes Produced |
|---|---|---|
| A Augmented | 19e | A; C sharp; E sharp; G |
| A Diminished | 19d | A; C; E flat; F sharp |
| A Seventh | 19c | A; C sharp; E; G |
| A Minor | 19b | A; C; E |
| A Major | 19a | A; C sharp; E |

TABLE XX

Logic for Upper Manual
(Three Sharps)
Third Row of Pedals to Right of Center

| Pedal | Pedal Number | Notes Programmed |
|---|---|---|
| A Augmented | 19e | A; C sharp; E sharp; G |
| A Diminished | 19d | A; C; E flat; F sharp |
| A Seventh | 19c | A; C sharp; E; G |
| A Minor | 19b | A; C; E |
| A Major | 19a | A; C sharp; E; F sharp |

TABLE XXI

Logic for Lower Manual
(Four Sharps)
Fourth Row of Pedals to Right of Center

| Pedal | Pedal Number | Notes Produced |
|---|---|---|
| E Augmented | 19e | E; G; C; D |
| E Diminished | 19d | E; G; B flat; C sharp |
| E Seventh | 19c | E; G sharp; B; D |
| E Minor | 19b | E; G; B |
| E Major | 19a | E; G sharp; B |

TABLE XXII

Logic for Upper Manual
(Four Sharps)
Fourth Row of Pedals to Right of Center

| Pedal | Pedal Number | Notes Programmed |
|---|---|---|
| E Augmented | 19e | E; G; C; D |
| E Diminished | 19d | E; G; B flat; C sharp |
| E Seventh | 19c | E; G sharp; B; D |
| E Minor | 19b | E; G; B |
| E Major | 19a | E; G sharp; B; C sharp |

TABLE XXIII

Logic for Lower Manual
(Five Sharps)
Fifth Row of Pedals to Right of Center

| Pedal | Pedal Number | Notes Produced |
|---|---|---|
| B Augmented | 19e | B; D sharp; G; A |
| B Diminished | 19d | B; D; F; G sharp |
| B Seventh | 19c | B; D sharp; A |
| B Minor | 19b | B; D; F sharp |
| B Major | 19a | B; D sharp; F sharp |

TABLE XXIV

Logic for Upper Manual
(Five Sharps)
Fifth Row of Pedals to Right of Center

| Pedal | Pedal Number | Notes Programmed |
|---|---|---|
| B Augmented | 19e | B; D; F |
| B Diminished | 19d | B; D; F |
| B Seventh | 19c | B; D; F |
| B Minor | 19b | B; D; F sharp |
| B Major | 19a | B; D sharp; F sharp; G sharp |

TABLE XXV

Logic for Lower Manual
(Six Sharps)
Sixth Row of Pedals to Right of Center

| Pedal | Pedal Number | Notes Produced |
|---|---|---|
| F Sharp Augmented | 19e | D flat; F; A; C flat |
| F Sharp Diminished | 19d | D flat; F flat; B flat |
| F Sharp Seventh | 19c | D flat; F; A flat; C flat |
| F Sharp Minor | 19b | D flat, F flat; A flat |
| F Sharp Major | 19a | D flat; F; A flat; B flat |

TABLE XXVI

Logic for Upper Manual
(Six Sharps)
Sixth Row of Pedals to Right of Center

| Pedal | Pedal Number | Notes Programmed |
|---|---|---|
| F Sharp Augmented | 19e | G flat; B flat; G; E |
| F Sharp Diminished | 19d | G flat; A; C; E flat |
| F Sharp Seventh | 19c | G flat; B flat; D flat; E |
| F Sharp Minor | 19b | G flat; A; D flat |
| F Sharp Major | 19a | G flat; B flat; D flat |

On the lower manual 43 there are only about fifteen notes which are used, in the middle range of the keyboard. The first, third and fifth notes of the scale are used in the present embodiment for producing a major chord, in response to the depression of a foot pedal 19*a*, the first note being the root note. With the upper manual, a sixth note is added to the first, third and fifth notes, the producing the major chord when foot pedal 51 is depressed.

Only about fifteen notes of the upper manual are also used. Therefore, there are, in some instances, inversions, the matrices 33 or 34 prescribing that the fifth or sixth notes, for example, be an octave below or above the root note.

In the "Gulbransen Pacemaker" electronic organ 40, the base 41, which is actuated each time a pedal 19*a*, 19*b*, 19*c*, 19*d* or 19*e* is depressed, has a "walking base" producing four notes to a measure, playing through the notes of the selected chord. Other organs may have two-four time, which is basic, playing the first and fifth notes.

It will be understood that, in electronic organ 40, the rhythm section 32 and the base 41 are interconnected so that the base comes in, on time, at the preset tempo. The rhythm section 42, itself, i.e., the drum, symbols, etc. are cut in and out, as desired by sidewise movement of the pedal 51. When cut in, it will play at the preset te,po.

The hands of the musician are normally free of the organ 40 and can be used intermittently to actuate and deactuate the customary stops for the elements which are listed in Table XXVII below. Each such element is conventional.

TABLE XXVII

Elements of Organ in FIG. 1

| Element or Step | Numeral |
|---|---|
| Lower Manual Volume Control | 100 |
| Bass, Volume Control | 101 |
| Timbre Volume Control | 102 |
| Upper Manual Volume Control | 103 |
| Preset Stops for Lower Manual | 104 |
| Bass Pattern Select | 105 |
| Drum Pattern Select | 106 |
| Preset Stops for Upper Manual | 107 |
| Upper Manual Stops | 108 |
| Speaker Control | 109 |
| On Off Switch | 110 |
| Tempo Control for Drums | 111 |
| Drum Volume Control | 112 |
| Volume Control | 113 |

From the foregoing, the operation of the device should be apparent. When the control elements of Table XXVII have been programmed in a conventional way on the machine, the musician sits in front of console 10 so that this left foot is used to depress selectively any one of the juxtaposed main pedals 19*a*, 19*b*, 19*c*, 19*d* or 19*e* so as to produce a chord from the lower manual 43 and from the bass 41. If rhythm, at a prescribed beat is desired, the rhythm section 42 is actuated by movement of this right foot so as to move pedal 51 sidewise. The rhythm section 42 and the bass 41 in organ 40 are conventionally interconnected so that the bass 41, be it a "walking bass", "two-four bass" or other, will be in time with the rhythm section 42. The musician, then, simply depresses and releases the pedal 51 with his right foot, periodically. This throws in and out, the chords of the upper manual 44.

What is claimed is:

1. In an electronic organ of the type having note generating means, and a bass assembly the combination of:

an array of foot pedals adapted for selection by foot depression;

a control pedal adapted for operation by foot depression;

first logic means connected with said note generating means for producing chords corresponding to selected notes;

second logic means connected with said note generating means for producing chords corresponding to other selected notes;

first switch means actuated by said foot pedals for energizing said first logic means, for enabling said second logic means and for energizing said bass assembly; and second switch means actuated by said control pedal for energizing said second logic means as enabled by said first switch means, whereby foot operation of said foot pedals and said control pedals provide chord accompaniment so as to free the musician's hands for playing a separate instrument.

2. The musical instrument defined in claim 1 wherein said organ includes a rhythm section, and including a rhythm switch controlled by said rhythm pedal for selectively actuating said rhythm section.

3. In an electronic organic of the type having note generating means, the combination therewith of:

a. a console;

b. control switches disposed in said console;

c. means connecting said switches to said not generation means for producing prescribed chords when a switch is actuated, certain of said switches being connected to said note generating means so as to cause said note generating means to produce, in different keys respectively, major chord combinations, certain other of said switches being connected to said note generating means so as to produce, in different keys respectively, minor chord combinations;

d. a plurality of juxtaposed foot pedals means projecting from said console, said foot pedals means being disposed arcuately and in a plurality of horizontal rows one over the other, said foot pedals means being connected respectively to said switches for respectively actuating said switches; the foot pedals means in one row being connected to said certain switches which cause the note generating means to generate major chord combinations; the foot pedals means in a second row being connected to said certain other switches which cause the note generating to generate minor chord combinations.

4. The electronic organ of claim 3 wherein said foot pedals means includes a third horizontal row and includes other switches actuated by said foot pedals means in said third row, means for connecting said other switches to said note generating means so as to cause said note generating means to produce, in different keys respectively, seventh chord note combintions.

5. The electronic organ of claim 4 wherein said foot pedals means includes a fourth horizontal row and includes still other switches actuated by said foot pedal means in said fourth row, means for connecting said still other switches to said note generating means so as to cause said note generating means to produce, in different keys respectively, diminished chord note combinations.

6. The electronic organ of claim 5 wherein said foot pedals means includes a fifth horizontal row and includes additional switches actuated by said foot pedals means in said fifth row, means for connecting said additional switches to said note generating means so as to cause said note generating means to produce, in different keys respectively, augmented chord note combinations.

7. In an electronic organ which includes an upper manual, a lower manual, a bass assembly, note generating means connected to said upper manual, said lower manual and said base assembly for producing musical notes selected at said upper manual, said lower manual and said bass assembly, and speaker means for sounding notes produced by said note generating means, the combination of:

an array of foot pedals adapted for selection by foot depression;

a control pedal adapted for operation by foot depression;

first logic means connected with said note generating means for producing chords corresponding to selection of notes at said lower manual;

second logic means connected with said note generating means for producing chords corresponding to selections at said upper manual;

first switch means actuated by said foot pedals for energizing said first logic means, for enabling said second logic means and for energizing said bass assembly; and second switch means actuated by said control pedal for energizing said second logic means as enabled by said first switch means, whereby foot operation of said foot pedals and said control pedals provide chord accompaniment so as to free the musician's hands for playing a separate instrument.

8. The musical instrument defined in claim 7 wherein said boat pedals are disposed in a plurality of horizontal rows, said rows being spaced vertically from each other and said boat pedals being sufficiently close to each other that they may be engaged selectively by one foot of a person seated adjacent thereto.

9. The musical instrument defined in claim 7 in which said first logic means includes a gate matrix the gates of which connect to individual circuits of the note generating means, a plurality of said gates being connected to said first switch means so that the closing of any one of said switches will simultaneously make a plurality of said individual circuits to cause said note generating means to produce a chord each time a selected foot pedal is depressed.

10. The musical instrument defined in claim 7 including a console, said foot pedals being mounted in said console for movement respectively from a normal position to a depressed position, said foot pedals being arranged in a plurality of horizontal rows, each horizontal row being spaced vertically above the next adjacent horizontal row, the respective foot pedals in one row being in general alignment vertically with the respective foot pedals of other rows, the foot pedals of one horizontal row being respectively actuatable for causing said note generating means to produce major chords in varying keys corresponding to the selected foot pedal, the foot pedals of another horizontal row being respectively actuable for causing the note generating means to produce, in the respective keys of the foot pedals therebelow, minor chords.

11. The musical instrument defined in claim 10 wherein the boat pedals of the other rows are actuatable for respective causing the note generating means to produce sevenths chords in response to actuation of the boat pedals of one row, augmented chords in response to the actuation of pedals of a second row, and diminished chords in response to the actuation of boat pedals in a third row.

12. The musical instrument defined in claim 7 wherein said organ includes a rhythm section, and including a rhythm switch controlled by said control pedal for selectively actuating said rhythm section.

* * * * *